US011515079B2

(12) United States Patent
Nakajima et al.

(10) Patent No.: US 11,515,079 B2
(45) Date of Patent: Nov. 29, 2022

(54) LAMINATED COIL

(71) Applicant: TAIYO YUDEN CO., LTD., Tokyo (JP)

(72) Inventors: Takashi Nakajima, Tokyo (JP); Keiko Shiroki, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 279 days.

(21) Appl. No.: 15/649,228

(22) Filed: Jul. 13, 2017

(65) Prior Publication Data

US 2018/0033544 A1 Feb. 1, 2018

(30) Foreign Application Priority Data

Jul. 29, 2016 (JP) ..... JP2016-150370
Jul. 6, 2017 (JP) ..... JP2017-133045

(51) Int. Cl.

| | |
|---|---|
| ***H01F 5/00*** | (2006.01) |
| ***H01F 27/32*** | (2006.01) |
| ***H01F 27/29*** | (2006.01) |
| ***H01F 27/28*** | (2006.01) |
| *H01F 41/04* | (2006.01) |

(52) U.S. Cl.

CPC ..... *H01F 27/327* (2013.01); *H01F 27/2804* (2013.01); *H01F 27/29* (2013.01); *H01F 41/042* (2013.01); *H01F 2027/2809* (2013.01)

(58) Field of Classification Search

CPC ..... H01F 27/327; H01F 2027/2809
USPC ..... 336/200
See application file for complete search history.

(56) References Cited

U.S. PATENT DOCUMENTS

2009/0002117 A1* 1/2009 Kawarai ..... H01F 17/0006 336/233
2010/0157565 A1* 6/2010 Yoshida ..... H01F 27/292 361/811
2010/0253463 A1* 10/2010 Shimomura ..... H01F 17/04 336/200

(Continued)

FOREIGN PATENT DOCUMENTS

JP 2010-087030 A 4/2010
JP 2013-153184 A 8/2013

(Continued)

OTHER PUBLICATIONS

Notice of Reasons for Refusal dated Apr. 13, 2021, issued in corresponding Japanese Patent Application No. 2017-133045, with English translation (14 pgs.).

*Primary Examiner* — Ronald Hinson
(74) *Attorney, Agent, or Firm* — Pillsbury Winthrop Shaw Pittman, LLP

(57) ABSTRACT

One object is to suppress thermal shrinkage of a cover resin layer at the time of thermal curing. A laminated coil according to one embodiment of the present invention is provided with a magnetic substrate formed of a sintered magnetic material, an insulation resin layer formed on the magnetic substrate, a cover resin layer formed on the insulation resin layer, and a coil conductor embedded in the insulation resin layer. In one embodiment of the present invention, said insulation resin layer includes a first resin and first filler particles, and said cover resin layer includes a second resin and second filler particles. A filling factor of the second filler particles in the cover resin layer is higher than a filling factor of the first filler particles in the insulation resin layer.

16 Claims, 8 Drawing Sheets

(56) References Cited

U.S. PATENT DOCUMENTS

| | | | | |
|---|---|---|---|---|
| 2010/0308949 | A1* | 12/2010 | Lim | H01F 17/0013 336/218 |
| 2011/0025442 | A1* | 2/2011 | Hsieh | H01F 17/0013 336/200 |
| 2011/0260825 | A1* | 10/2011 | Doljack | H01F 17/04 336/221 |
| 2012/0112869 | A1* | 5/2012 | Nishikawa | H01F 17/0013 336/200 |
| 2013/0127576 | A1* | 5/2013 | Hachiya | H01F 27/255 336/200 |
| 2013/0249664 | A1* | 9/2013 | Tonoyama | H01F 41/04 336/200 |
| 2014/0159849 | A1 | 6/2014 | Bae et al. | |
| 2015/0145629 | A1* | 5/2015 | Chang | H01F 17/0006 336/192 |
| 2015/0371752 | A1* | 12/2015 | Park | H01F 27/255 336/200 |
| 2016/0225513 | A1* | 8/2016 | Park | H01F 17/0013 |

FOREIGN PATENT DOCUMENTS

| | | | |
|---|---|---|---|
| JP | 2014-116589 | A | 6/2014 |
| JP | 2015-170843 | A | 9/2015 |
| JP | 2016-009858 | A | 1/2016 |

* cited by examiner

LAMINATED COIL

CROSS-REFERENCE TO RELATED APPLICATIONS

This application is based on and claims the benefit of priority from Japanese Patent Application Serial Nos. 2016-150370 (filed on Jul. 29, 2016) and 2017-133045 (filed on Jul. 6, 2017), the contents of which are hereby incorporated by reference in their entirety.

TECHNICAL FIELD

The present disclosure relates to a laminated coil. More specifically, the present disclosure relates to a laminated coil provided with a magnetic substrate formed of a sintered magnetic material and a resin layer formed on said magnetic substrate.

BACKGROUND

A conventional laminated coil is fabricated by forming an insulation resin layer including a coil conductor on a magnetic substrate formed of a sintered magnetic material such as ferrite and forming a cover resin layer on said insulation resin layer. The cover resin layer includes, for example, filler particles such as ferrite particles and an insulating resin such as an epoxy resin. Laminated coils of such a conventional type are disclosed in, for example, Japanese Patent Application Publication No. 2010-087030 and Japanese Patent Application Publication No. 2013-153184.

In manufacturing the conventional laminated coil, a laminate composed of the magnetic substrate, the insulation resin layer, and the cover resin layer is heated so that resins included in said insulation resin layer and cover resin layer are thermally cured. At this time, while the resins in said insulation resin layer and cover resin layer shrink, the magnetic substrate does not shrink since it has already been sintered. Because of this, the conventional laminated coil has been problematic in that due to heating in a manufacturing process, stress is exerted on the magnetic substrate, rendering the magnetic substrate prone to deformation. In the laminated coil, the cover resin layer is formed to be thicker than the insulation resin layer, so that shrinkage of the cover resin layer causes large stress to be exerted on the magnetic substrate.

SUMMARY

In order to solve this problem, one of objects of the present disclosure is to provide a laminated coil that suppresses thermal shrinkage of a cover resin layer caused at the time of thermal curing. Other objects of the present invention will be made apparent through description of the specification as a whole.

The inventor of the present invention has discovered that a shrinkage amount of an insulation layer at the time of thermal curing can be suppressed by including a filler at a high filling factor in a cover resin layer.

A laminated coil according to one embodiment of the present invention is provided with a magnetic substrate formed of a sintered magnetic material, an insulation resin layer formed on the magnetic substrate, a cover resin layer formed on the insulation resin layer, and a coil conductor embedded in the insulation resin layer. In one embodiment of the present invention, said insulation resin layer includes a first resin and first filler particles, and said cover resin layer includes a second resin and second filler particles.

In one embodiment of the present invention, a filling factor of the second filler particles in the cover resin layer is higher than a filling factor of the first filler particles in the insulation resin layer. According to these embodiments, since a filling factor of the second filler particles in the cover resin layer is higher than a filling factor of the first filler particles in the insulation resin layer, even when the second resin in the cover resin layer is thermally cured, a shrinkage amount of said cover resin layer is reduced. Thus, the magnetic substrate can be prevented from being deformed at the time of thermal curing. In a more specific embodiment, a filling factor of the second filler particles in the cover resin layer is set to not less than 70 vol % and, more preferably, to not less than 80 vol %.

In one embodiment of the present invention, the second filler particles have a spherical shape. By this configuration, compared with a case where the filler particles have any other shape than a spherical shape, it becomes easier to improve a filling factor of the second filler particles.

A laminated coil according to one embodiment of the present invention is provided with a magnetic substrate formed of a sintered magnetic material, an insulation resin layer formed on the magnetic substrate, a cover resin layer formed on the insulation resin layer, and a coil conductor embedded in the insulation resin layer. In one embodiment of the present invention, said insulation resin layer includes a first resin, and said cover resin layer includes a second resin and second filler particles. In one embodiment of the present invention, the insulation resin layer is configured not to include filler particles. Furthermore, in one embodiment of the present invention, the filler particles included in the cover resin layer are metal magnetic particles. In one embodiment of the present invention, a filling factor of the filler particles in the cover resin layer is set to not less than 80 vol %. According to these embodiments, even when the second resin in the cover resin layer is thermally cured, a shrinkage amount of said cover resin layer can be suppressed to such an extent as to prevent the magnetic substrate from being deformed.

Advantages

According to the disclosure in this specification, there can be provided a laminated coil that suppresses thermal shrinkage of an insulation layer caused at the time of thermal curing.

DESCRIPTION OF THE PREFERRED EMBODIMENTS

Figure 1:
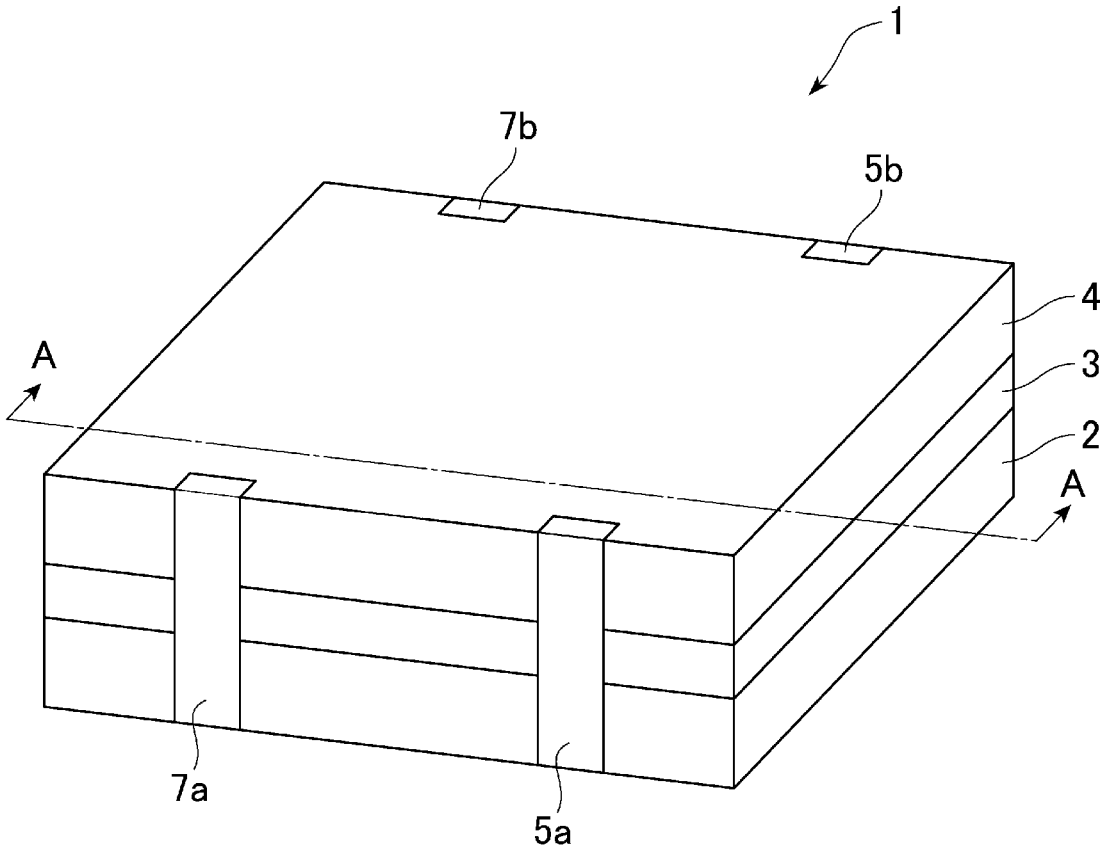
FIG. 1 is a perspective view of a laminated coil according to one embodiment of the present invention.

By referring appropriately to the appended drawings, the following describes various embodiments of the present invention. Constituent components common to a plurality of drawings are denoted by the same reference characters throughout said plurality of drawings. It is to be noted that, for the sake of convenience of description, the drawings are not necessarily depicted to scale.

Figure 2:
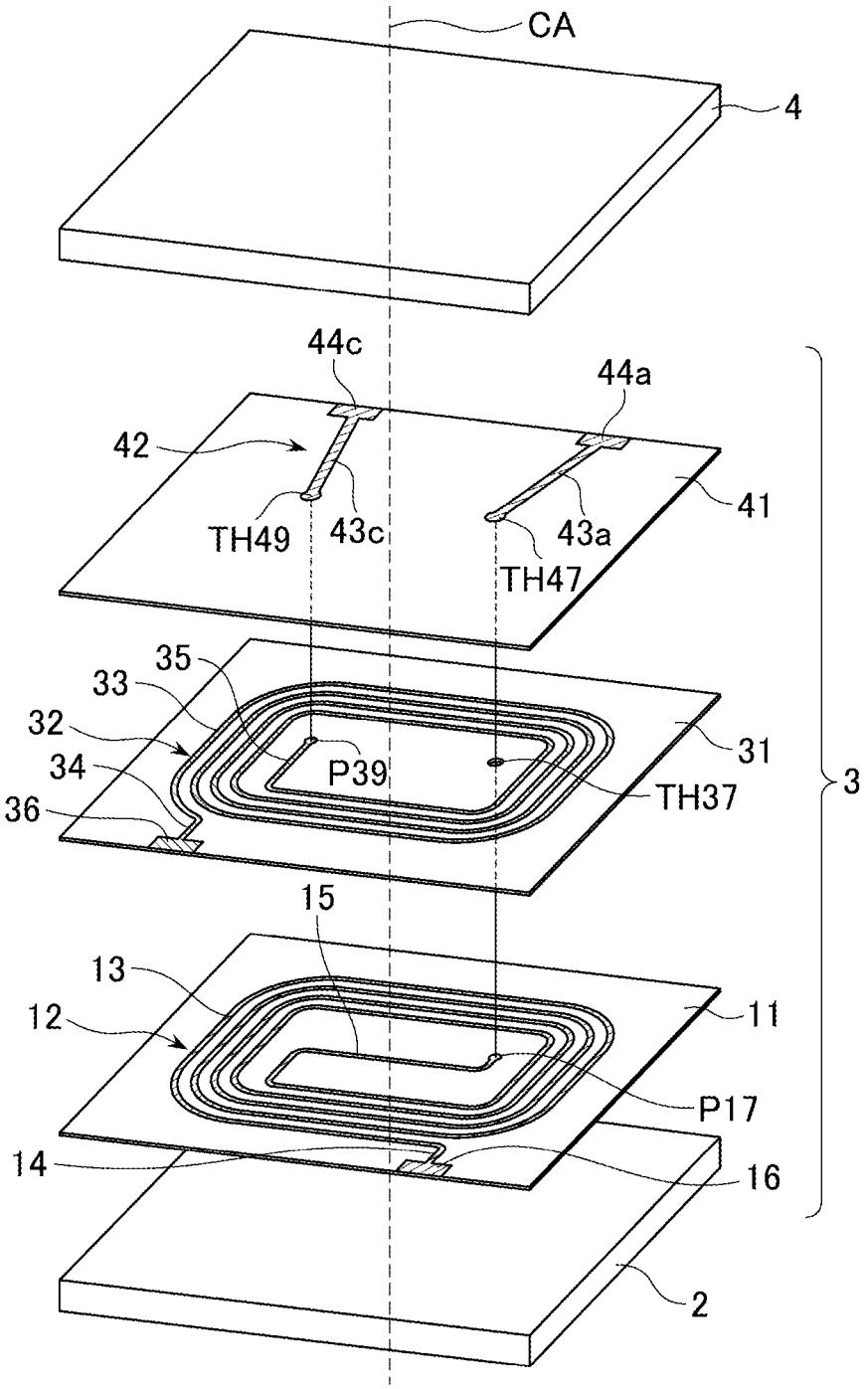
FIG. 2 is an exploded perspective view of the laminated coil according to one embodiment of the present invention.
Figure 6:
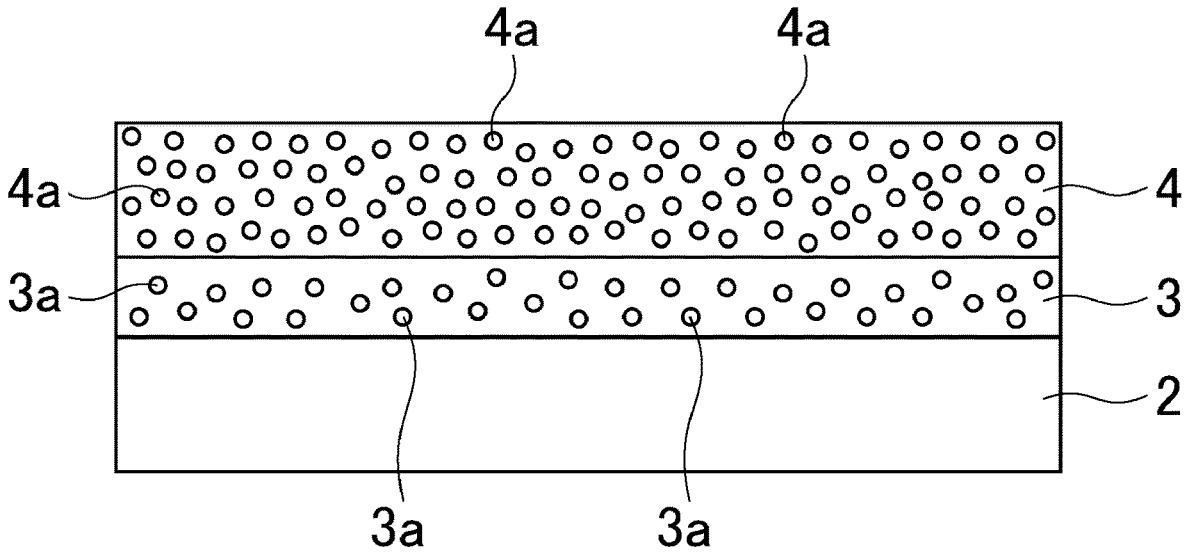
FIG. 6 is a sectional view taken along a line A-A of the laminated coil in FIG. 1.

FIG. 1 is a perspective view of a laminated coil according to one embodiment of the present invention, FIG. 2 is an exploded perspective view of the laminated coil shown in FIG. 1, and FIG. 6 is a sectional view taken along a line A-A of the laminated coil in FIG. 1. These drawings show a laminated common mode coil as an example of a laminated coil to which the present invention is applicable. A laminated common mode coil 1 may be provided with a magnetic substrate 2, an insulation resin layer 3, a cover resin layer 4, and terminal electrodes 5*a*, 5*b*, 7*a*, and 7*b*. The laminated common mode coil 1 may have dimensions of, for example, 0.45 mm×0.3 mm×0.23 mm. As is obvious to those skilled in the art, the laminated coil can be used in various other applications besides a common mode coil. For example, it may also be possible that the laminated coil is any of various types of inductors incorporated into a power source line or a signal line. These various types of inductors each may be used, for example, in a power source circuit as a voltage conversion inductor or a choke inductor configured to cut a high-frequency component and can be used in a signal line as a matching inductor or a resonance inductor. The invention disclosed in this specification may be applicable to these various types of inductors.

The magnetic substrate 2 may be a sintered magnetic material. The magnetic substrate 2 may be obtained by, for example, forming a mixture of the magnetic material and an organic binder, forming a molded body by molding this mixture in a sheet form, and firing the molded body. Examples of the magnetic material used for forming the magnetic substrate 2 may include a ferrite material and a metal magnetic material. As the ferrite material used to form the magnetic substrate 2, for example, Ni—Zn ferrite and Mn—Zn ferrite can be used. Furthermore, as the metal magnetic material used to form the magnetic substrate 2, for example, a Fe—Si—Cr, Fe—Si—Al, or Fe—Ni alloy or a material obtained by mixing them can be used. Materials of the magnetic substrate 2 applicable to the present invention are not limited to those specified in this specification.

The insulation resin layer 3 may be configured by stacking on each other, a plurality of insulation layers and a conductor layer formed on each of said plurality of insulation layers. In one embodiment of the present invention, each of the insulation layers may be made of a resin in which a multitude of filler particles 3*a* (see FIG. 6) are dispersed. In another embodiment of the present invention, each of the insulation layers may be made of a resin including no filler particles. In one embodiment of the present invention, as the resin included in the insulation resin layer 3, a thermosetting resin having an excellent insulation property may be used, such as, for example, an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PB 0) resin. The insulation resin layer 3 will be further described later with reference to FIG. 2. The insulation resin layer 3 may be formed to have a thickness of 30 μm to 60 μm.

The cover resin layer 4 may be obtained by applying, on the insulation resin layer 3, a resin in which a multitude of filler particles 4*a* are dispersed. In one embodiment of the present invention, as the resin included in the cover resin layer 4, a thermosetting resin having an excellent insulation property may be used, such as, for example, an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin. The resin in the cover resin layer 4 may be the same type of resin as or a different type of resin from the resin used in the insulation resin layer 3.

In one embodiment of the present invention, the filler particles 3*a* and the filler particles 4*a* may be particles of a ferrite material, metal magnetic particles, particles of an inorganic material such as SiO2 or Al2O3, or glass-based particles. Particles of a ferrite material applicable to the present invention may be, for example, particles of Ni—Zn ferrite or particles of Ni—Zn—Cu ferrite. Metal magnetic particles applicable to the present invention may be of a material in which magnetism is developed in an unoxidized metal portion, and may be, for example, particles including unoxidized metal particles or alloy particles. Metal magnetic particles applicable to the present invention may include particles of, for example, an Fe—Si—Cr, Fe—Si—Al, or Fe—Ni alloy, an Fe—Si—Cr—B—C or Fe—Si—B—Cr amorphous alloy, Fe, or a material obtained by mixing them. Metal magnetic particles applicable to the present invention may further include particles of Fe—Si—Al or FeSi—Al—Cr. Pressurized powder bodies obtained from these types of particles can also be used as the metal magnetic particles of the present invention. Moreover, these types of particles or pressurized powder bodies obtained therefrom each having a surface thermally treated to form an oxidized film thereon can also be used as the metal magnetic particles of the present invention. Metal magnetic particles applicable to the present invention may be manufactured by, for example, an atomizing method. Furthermore, metal magnetic particles applicable to the present invention can be manufactured by using a known method. Furthermore, commercially available metal magnetic particles can also be used in the present invention. Examples of commercially available metal magnetic particles may include PF-20F manufactured by Epson Atmix Corporation and SFR—FeSiAl manufactured by Nippon Atomized Metal Powders Corporation. Metal magnetic particles of such types may have a spherical particle shape, be easily brought in such mutual proximity as to be bound to each other via the oxidized film, and have a high specific gravity, so that compared with a case of using Ni—Zn or Mn—Zn ferrite magnetic particles, a filling factor thereof can be increased more easily. With a filling factor of the filler particles increased, shrinkage of the cover resin layer at the time of thermally curing the resins can be further suppressed, and an increased magnetic permeability (μ) can be obtained With an increased magnetic permeability (μ) obtained, electrical characteristics of the laminated coil can be improved.

In one embodiment of the present invention, either or both of the filler particles 3*a* and the filler particles 4*a* may be formed in a flattened shape. It may also be possible that the filler particles 3*a* and the filler particles 4*a* that are formed in a flattened shape are set to have an aspect ratio (a flattening ratio) of, for example, not less than 1.5, not less than 2, not less than 3, not less than 4, or not less than 5. An aspect ratio of filler particles refers to a length of said particles in a longest axis direction with respect to a length thereof in a shortest axis direction (a length in the longest axis direction/a length in the shortest axis direction).

Figure 7:
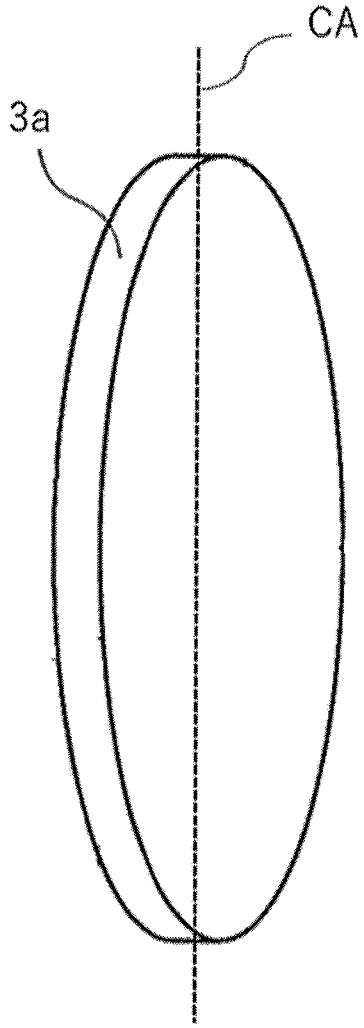
FIG. 7 is an illustration of a flattened first filler particle whose longest axis direction is parallel to a coil axis.

In one embodiment of the present invention, the filler particles 3*a* may be included in the insulation resin layer 3 so as to assume such a posture that a longest axis direction of part or an entirety of the filler particles 3*a* is oriented to a direction parallel to a coil axis CA (see FIG. 7) and a short axis thereof is oriented to a direction perpendicular to the coil axis CA. With the filler particles 3*a* assuming such a posture, a magnetic permeability of the insulation resin layer 3 in the direction parallel to the coil axis CA may become larger than that in the direction perpendicular to the coil axis CA. Thus, the direction parallel to the coil axis CA may function as an easy magnetization direction of the insulation resin layer 3, and the direction perpendicular to the coil axis CA may function as a hard magnetization direction of the insulation resin layer 3. In the insulation resin layer 3, magnetic flux may be oriented generally to the direction parallel to the coil axis CA, and thus with the direction parallel to the coil axis CA set as the easy magnetization direction, an effective magnetic permeability of the laminated coil can be improved. In a case where the present invention is applied to a resonance inductor or other various types of inductors, it may be preferable to use the filler particles 3*a* having such a flattened shape as filler particles for the insulation resin layer 3.

Figure 8:
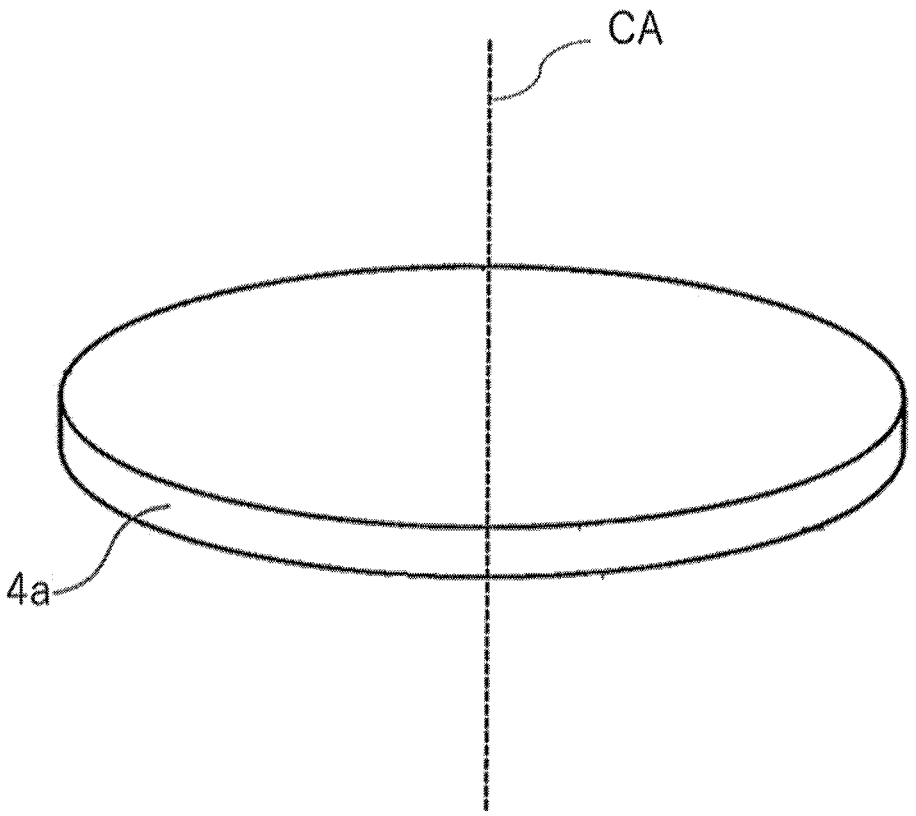
FIG. 8 is an illustration of a second filler particle formed in a flattened shape whose longest axis direction is perpendicular to the coil axis.

In one embodiment of the present invention, the filler particles 4*a* may be included in the cover resin layer 4 so as to assume such a posture that a longest axis direction of part or an entirety of the filler particles 4*a* is oriented to the direction perpendicular to the coil axis CA (see FIG. 8) and a short axis thereof is oriented to the direction parallel to the coil axis CA. With the filler particles 4*a* assuming such a posture, a magnetic permeability of the cover resin layer 4 in the direction perpendicular to the coil axis CA may become larger than that in the direction parallel to the coil axis CA. Thus, the direction perpendicular to the coil axis CA may function as an easy magnetization direction of the cover resin layer 4, and the direction parallel to the coil axis CA may function as a hard magnetization direction of the cover resin layer 4. In the cover resin layer 4, magnetic flux may be oriented generally to the direction perpendicular to the coil axis CA except in a vicinity of a boundary between the cover resin layer 4 and the insulation resin layer 3, and thus with the direction perpendicular to the coil axis CA set as the easy magnetization direction, an effective magnetic permeability of the laminated common mode coil 1 can be improved. Also in a case where the present invention is applied to a resonance inductor or other various types of inductors, with the filler particles 4*a* having such a flattened shape used and the direction perpendicular to the coil axis CA set as the easy magnetization direction of the cover resin layer 4, an effective magnetic permeability of said various types of inductors can be improved. In a case where metal magnetic particles are used as the filler particles 3*a*, it may become likely that an eddy current is generated in said metal magnetic particles, causing core loss. In this case, with the filler particles 4*a* having a flattened shape used and the direction perpendicular to the coil axis CA set as the easy magnetization direction of the cover resin layer 4, an effective magnetic permeability of the laminated coil of the present invention may be increased, and core loss can be suppressed to a low degree. As a result, such a laminated coil can be used even in a high-frequency region. Furthermore, with the filler particles 4*a* having a flattened shape set to assume such a posture that the longest axis direction thereof is oriented to the direction perpendicular to the coil axis CA, a linear expansion coefficient in the direction perpendicular to the coil axis CA can be decreased, so that a thermal stress difference between the cover resin layer 4 and the magnetic substrate 2 can be decreased.

In one embodiment, respective amounts of the filler particles 4*a* and the filler particles 3*a* may be adjusted so that a filling factor of the filler particles 4*a* in the cover resin layer 4 is higher than a filling factor of the filler particles 3*a* in the insulation resin layer 3. Preferably, a filling factor of the filler particles 4*a* may be 10% or more larger than a filling factor of the filler particles 3*a*, and, more preferably, a filling factor of the filler particles 4*a* may be 20% or more larger than a filling factor of the filler particles 3*a*.

In one embodiment of the present invention, the filler particles 4*a* in the cover resin layer 4 may form part of a magnetic circuit. Thus, a filling factor thereof may have a correlation to a magnetic permeability of a magnetic circuit portion. Specifically, the higher a filling factor of the filler particles 4*a* in the cover resin layer 4, the higher a magnetic permeability of the magnetic circuit. Meanwhile, in forming the cover resin layer, when consideration is given to handling ease thereof in a manufacturing process and also to a fact that no large pressure is applied thereto in the manufacturing process, there may be a limitation on an upper limit of a filling factor of the filler particles 4*a* in the cover resin layer 4. With these in view, in one embodiment of the present invention, in order to form an excellent magnetic circuit having a high magnetic permeability with good handling ease in the manufacturing process, a preferred filling factor of the filler particles 4*a* may be not less than 70 vol % and less than 90 vol %. A filling factor of the filler particles 3*a* may be selected so as to be smaller than this value.

In one embodiment of the present invention, a filling factor of the filler particles 4*a* in the cover resin layer 4 may be set to not less than 80 vol %. The insulation resin layer 3 may be typically formed to be thinner than the cover resin layer 4 and have a thermally non-shrinkable coil conductor embedded therein, so that the insulation resin layer 3 may hardly shrink at the time of thermal curing. For this reason, at the time of thermal curing, a shrinkage amount of the insulation resin layer 3 may be suppressed compared with a shrinkage amount of the cover resin layer 4. Thus, shrinkage of the insulation resin layer 3 at the time of thermal curing is suppressed even when the insulation resin layer 3 does not include the filler particles 3*a*.

The terminal electrodes 5*a*, 5*b*, 7*a*, and 7*b* may be provided on side surfaces of the insulation resin layer 3 and extend, as shown in the figure, to an upper surface and a lower surface of the laminated common mode coil 1. The terminal electrodes 5*a*, 5*b*, 7*a*, and 7*b* may be formed by, for example, applying an Ag paste to the side surfaces of the insulation resin layer 3.

Next, with reference to FIG. 2 to FIG. 5, a description is given of the insulation resin layer 3. In this specification, when an up-and-down direction is referred to, unless contextually interpreted otherwise, "up" may refer to an upward direction in FIG. 2 and "down" may refer to a downward direction in FIG. 2. As shown in the exploded perspective view of FIG. 2, in one embodiment of the present invention, the insulation resin layer 3 may include an insulation layer 11, a conductor layer 12, an insulation layer 31, a conductor layer 32, an extraction electrode insulation layer 41, and an extraction conductor layer 42, which are stacked between the magnetic substrate 2 and the cover resin layer 4.

Each of the insulation layer 11, the insulation layer 31, and the extraction electrode insulation layer 41 may be a layer made of a resin in which the filler particles 3*a* are dispersed and have an excellent insulation property. The conductor layer 12, the conductor layer 32, and the extraction conductor layer 42 may be each formed of a metal material such as Ag. It may be desirable that the metal material be excellent in conductivity and workability. As the metal material, besides Ag, Cu or Al can be used. These materials of the insulation layers and the conductor layers may be illustrative only, and depending on required performance and required characteristics of the laminated common mode coil 1, besides the materials explicitly described in this specification, various other materials can also be used.

Figure 3:
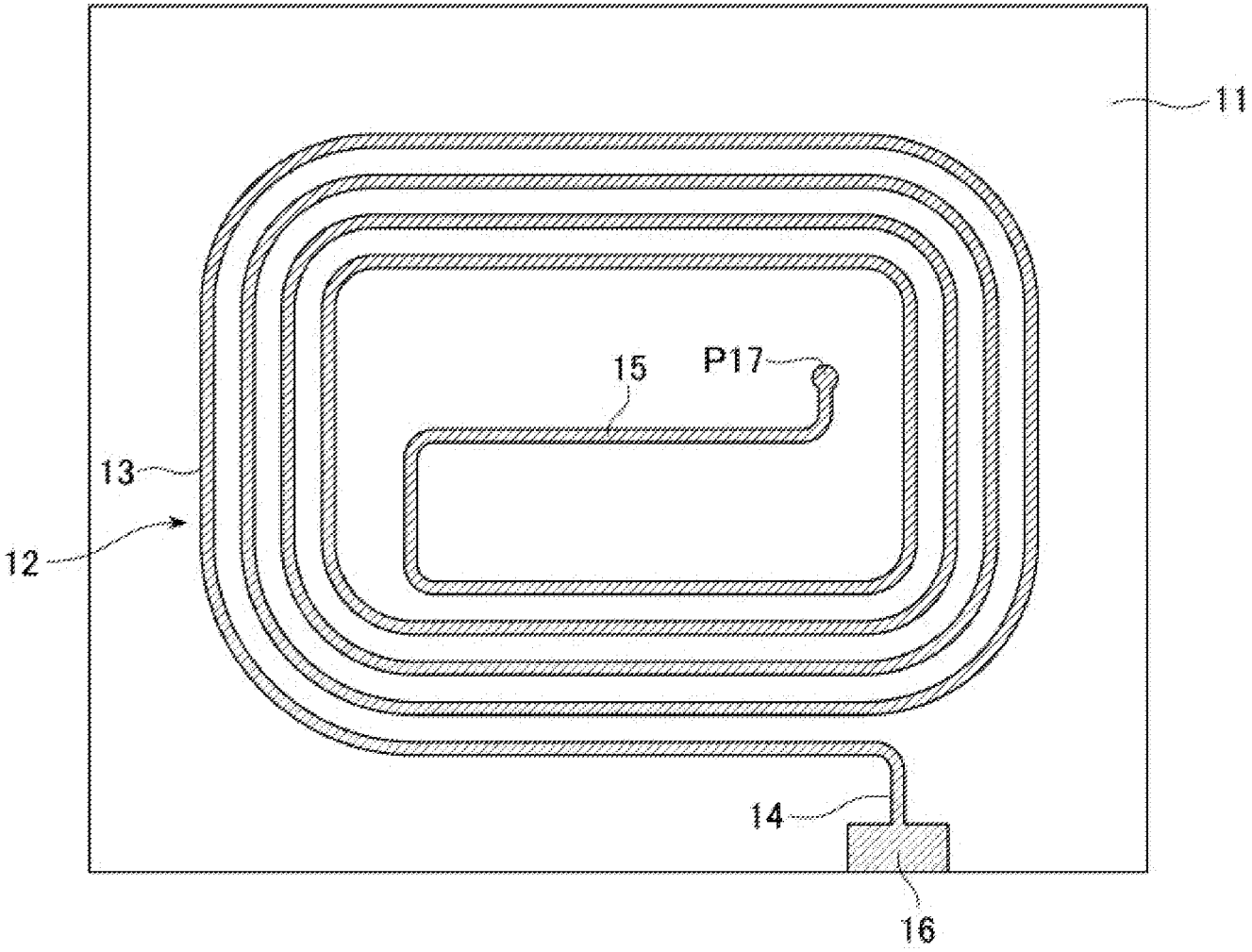
FIG. 3 is a plan view showing a first insulation layer and a first conductor layer formed on said first insulation layer, which are provided in the laminated coil in FIG. 2.

As shown in FIG. 2, in the insulation resin layer 3, the insulation layer 11 may be formed on the magnetic substrate 2. On the insulation layer 11, the conductor layer 12 may be formed. As shown in FIG. 3, the conductor layer 12 may be provided with a coil conductor 13, an extraction conductor 14 whose one end is connected to an outer side end portion of the coil conductor 13, an extraction conductor 15 whose one end is connected to an inner side end portion of the coil conductor 13, and an extraction electrode 16 connected to the extraction conductor 14. The extraction electrode 16 may be electrically connected to the terminal electrode 5*a*. The coil conductor 13 may be wound a plurality of turns around the coil axis CA, thus having a spiral shape. The coil axis CA may be a virtual axis extending in a stacking direction of the insulation resin layer 3 (namely, the up-and-down direction of the laminated common mode coil 1). In one embodiment, the coil axis CA may extend in a direction substantially orthogonal to the insulation layer 11.

Figure 4:
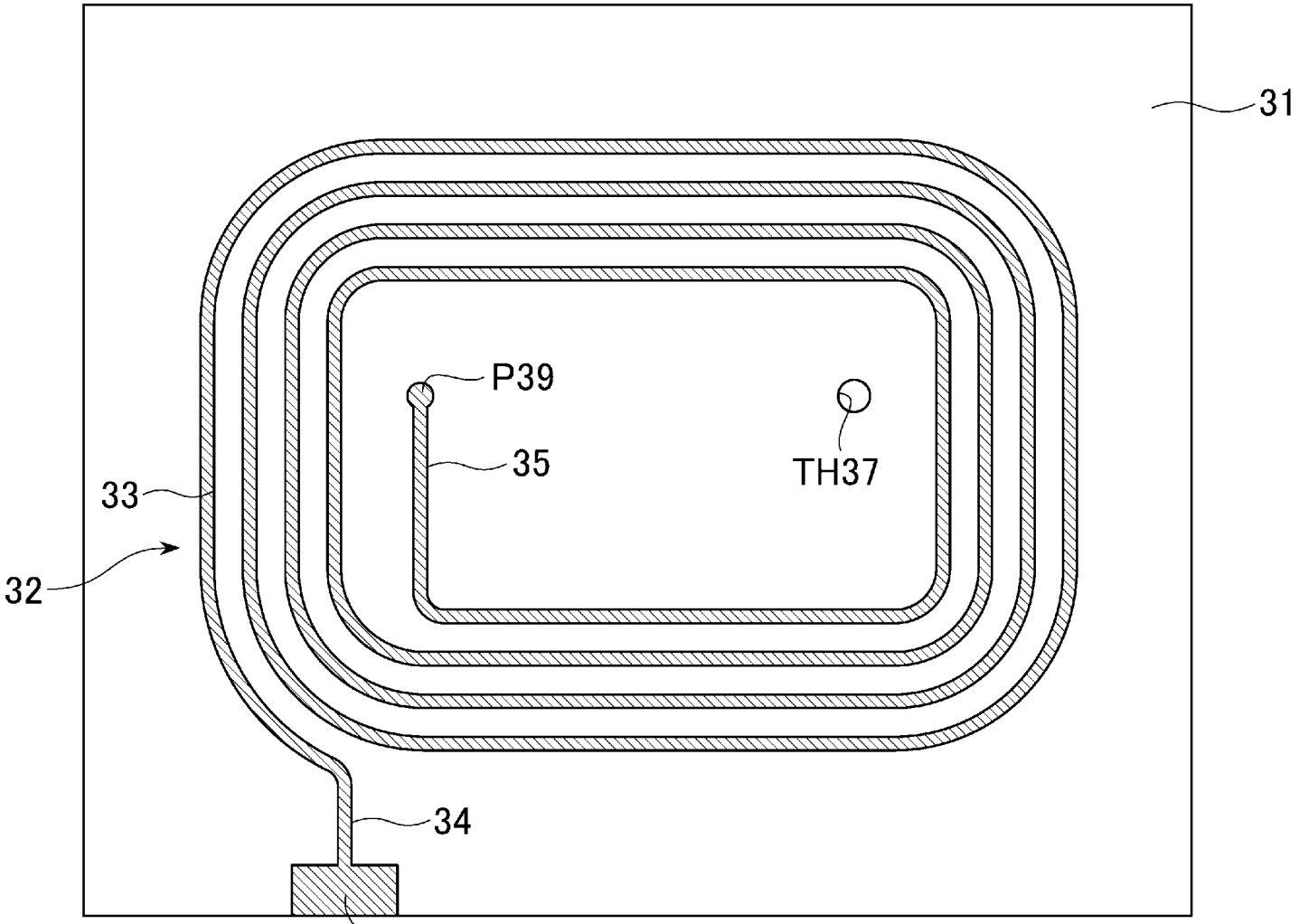
FIG. 4 is a plan view showing a third insulation layer and a third conductor layer formed on said third insulation layer, which are provided in the laminated coil in FIG. 2.
Figure 5:
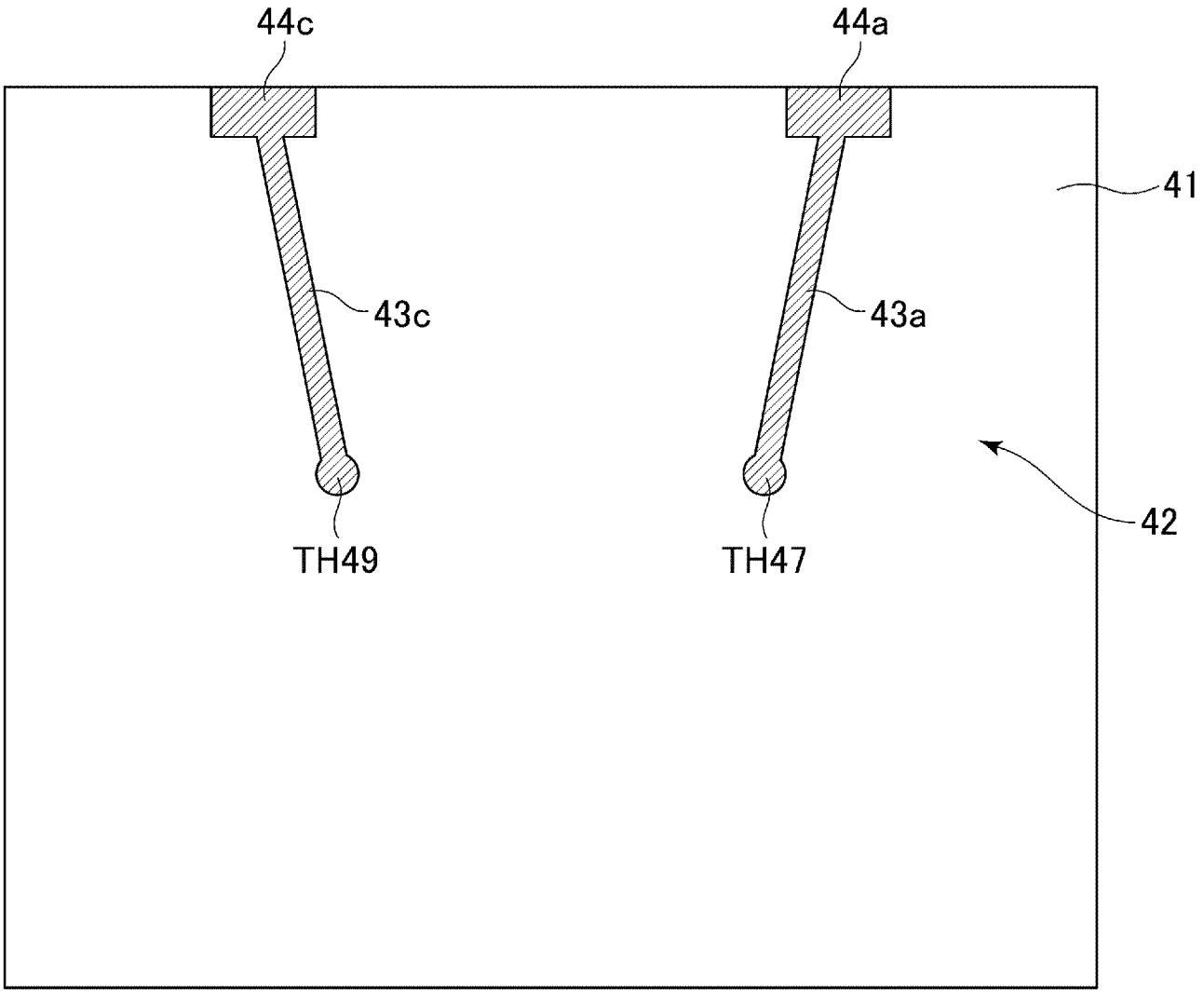
FIG. 5 is a plan view showing a fourth insulation layer and a fourth conductor layer formed on said fourth insulation layer, which are provided in the laminated coil in FIG. 2.

On the conductor layer 12, the insulation layer 31 may be formed. On said insulation layer 31, the conductor layer 32 may be formed. As shown in FIG. 4, the conductor layer 32 may be provided with a spiral-shaped coil conductor 33, an extraction conductor 34 whose one end is connected to an outer side end portion of the coil conductor 33, an extraction conductor 35 whose one end is connected to an inner side end portion of the coil conductor 33, and an extraction electrode 36 connected to the extraction conductor 34. The extraction electrode 36 may be electrically connected to the terminal electrode 7*a*. The coil conductor 33 may be wound a plurality of turns around the coil axis CA, thus having a spiral shape.

On the conductor layer 32, the extraction electrode insulation layer 41 may be formed. On said extraction electrode insulation layer 41, the extraction conductor layer 42 may be formed. The extraction conductor layer 42 may be provided with an extraction conductor 43*a*, an extraction conductor 43*c*, an extraction electrode 44*a* connected to the extraction conductor 43*a*, and an extraction electrode 44*c* connected to the extraction conductor 43*c*. The extraction electrode 44*a* may be electrically connected to the terminal electrode 5*b*. The extraction electrode 44*c* may be electrically connected to the terminal electrode 7*b*.

In order to connect an end portion of the extraction conductor 15 of the conductor layer 12 to an end portion of the extraction conductor 43*a*, a pad P17 may be formed on the insulation layer 11, a through hole TH37 may be formed through the insulation layer 31, and a through hole TH47 may be formed through the extraction electrode insulation layer 41. The through holes TH37 and TH47 may be formed by embedding a metal material such as Ag in penetration holes formed through the insulation layer 31 and the extraction electrode insulation layer 41, respectively. Furthermore, in order to connect an end portion of the extraction conductor 35 of the conductor layer 32 to an end portion of the extraction conductor 43*c*, a pad P39 may be formed on the insulation layer 31, and a through hole TH49 may be formed through the extraction electrode insulation layer 41. These pads and through holes may be formed similarly to the pad P17 and the through hole TH27, respectively.

By the above-mentioned configuration and arrangement, in the laminated common mode coil 1, two coils may be provided between the terminal electrodes 5*a* and 7*a* and the terminal electrodes 5*b* and 7*b*. That is, an outer side end of the coil conductor 13 may be electrically connected to the terminal electrode 5*a* via the extraction conductor 14 and the extraction electrode 16, and an inner side end of the coil conductor 13 may be electrically connected to the terminal electrode 5*b* via the extraction conductor 15, the pad P17, the through hole TH27, the through hole TH37, the through hole TH47, the extraction conductor 43*a*, and the extraction electrode 44*a*, so that a first coil including the coil conductor 13 may be configured between the terminal electrode 5*a* and the terminal electrode 5*b*. Furthermore, an outer side end of the coil conductor 33 may be electrically connected to the terminal electrode 7*a* via the extraction conductor 34 and the extraction electrode 36, and an inner side end of the coil conductor 33 may be electrically connected to the terminal electrode 7*b* via the extraction conductor 35, the pad P39, the through hole TH49, the extraction conductor 43*c*, and the extraction electrode 44*c*, so that a second coil including the coil conductor 33 may be configured between the terminal electrode 7*a* and the terminal electrode 7*b*. These two coils may be each a planar coil formed on a plane. These two coils may be connected to signal lines in an external circuit, respectively. It may also be possible that the laminated common mode coil 1 is configured to include three or more coils. In a case where the laminated common mode coil 1 has three coils, said laminated common mode coil 1 can be used as a common mode choke coil in which the three coils are connected respectively to three signal lines in a differential transmission circuit conforming to C-PHY developed by the MIPI Alliance.

Next, a description is given of one example of a method for manufacturing the laminated common mode coil 1. First, the magnetic substrate 2 may be formed from a magnetic material. More specifically, first, a mixture of the magnetic material such as Ni—Zn ferrite and an organic binder may be formed, followed by forming a molded body by molding this mixture in a sheet form. Next, this molded body may be sintered to form a sheet-form sintered body. Then, this sintered body may be subjected to required post-processing (such as cutting and polishing), and thus the magnetic substrate 2 may be obtained.

Next, on an upper surface of the magnetic substrate 2, a thermosetting resin (for example, an epoxy resin) in which the filler particles 3*a* are disposed may be applied by, for example, a spin coating method and thermally cured, and thus the insulation layer 11 may be obtained. The insulation layer 11 may be formed to have a thickness of, for example, about 1.0 to 20 μm. Through the insulation layer 11, penetration holes may be formed at positions corresponding to the through holes, respectively.

Next, on the insulation layer 11, the conductor layer 12 may be formed by a known method. The conductor layer 12 may be formed by, for example, photolithography. The conductor layer 12 may be formed to have a thickness of, for example, about 5.0 to 20 μm.

Next, on the conductor layer 12, the insulation layer 31 may be formed by a similar method to that used to form the insulation layer 11. Specifically, the insulation layer 31 may be formed by, for example, applying thereon a thermosetting resin (for example, an epoxy resin) in which the filler particles 3*a* are dispersed by, for example, a spin coating method and thermally curing the resin thus applied. The insulation layer 31 may be formed to have a thickness of, for example, about 1.0 to 20 μm. Through the insulation layer 31, penetration holes may be formed at positions corresponding to the through holes, respectively.

Next, on the insulation layer 31, the conductor layer 32 may be formed by a similar method to that used to form the conductor layer 12. Specifically, similarly to the conductor layer 12, the conductor layer 32 may be formed by, for example, photolithography. The conductor layer 12 may be formed to have a thickness of, for example, about 5.0 to 20 μm. The conductor layer 32 may be formed to have a thickness of, for example, about 5.0 to 20 μm.

Next, on the conductor layer 32, the extraction electrode insulation layer 41 may be formed by a similar method to that used to form the insulation layer 11 and the insulation layer 31. Specifically, the extraction electrode insulation layer 31 may be formed by, for example, applying a thermosetting resin (for example, an epoxy resin) in which the filler particles are dispersed on the conductor layer 32 by, for example, a spin coating method and thermally curing the resin thus applied. The extraction electrode insulation layer 41 may be formed to have a thickness of, for example, about 1.0 to 20 μm. Through the extraction electrode insulation layer 41, penetration holes may be formed at positions corresponding to the through holes, respectively.

Next, on the extraction electrode insulation layer 41, the extraction conductor layer 42 may be formed by a similar method to that used to form the conductor layer 12 and the conductor layer 32. Specifically, similarly to the conductor layer 12 and the conductor layer 32, the extraction conductor layer 42 may be formed by, for example, photolithography. The extraction conductor layer 42 may be formed to have a thickness of, for example, about 5.0 to 20 μm.

Next, on the extraction conductor layer 42, a thermosetting resin (for example, an epoxy resin) in which the filler particles 4*a* are dispersed may be applied by, for example, a spin coating method and thermally cured, and thus the cover resin layer 4 may be obtained. The cover resin layer 4 may be formed to have a thickness of, for example, about 50 to 300 μm. A surface of the cover resin layer 4 may be polish-processed as required, and thus it may also be possible that the cover resin layer 4 has a reduced thickness in the layered common mode coil 1 as a completed product.

In the above-mentioned process steps, the through holes (TH37 and so on) and the pads (P17 and so on) may also be formed together with patterns corresponding to the conductor layer 12 and the conductor layer 32.

On side surfaces of a laminated chip thus formed, the terminal electrodes 5*a*, 5*b*, 7*a*, and 7*b* may be formed by, for example, plating. The laminated common mode coil 1 may be formed in this manner. The above-mentioned method for fabricating the laminated common mode coil 1 may be merely one example, and a method for forming a layered common mode coil to which the present invention is applicable may not be limited thereto.

In the laminated common mode coil 1 thus obtained, a filling factor of the filler particles 4*a* in the cover resin layer 4 is higher than a filling factor of the filler particles 3*a* in the insulation resin layer 3, and thus compared with the insulation resin layer 3, the cover resin layer 4 may hardly shrink at the time of thermal curing. Furthermore, the insulation resin layer 3 may be formed to be thinner than the cover resin layer 4 and have a thermally non-shrinkable coil conductor 12 embedded therein, so that the insulation resin layer 3 may hardly shrink at the time of thermal curing. Particularly in the laminated common mode coil 1, the coil conductors may be disposed substantially entirely on the layers in the insulation resin layer 3, and thus the insulation resin layer 3 may hardly shrink at the time of thermal curing. As described above, in the laminated common mode coil 1, respective shrinkage amounts of the insulation resin layer 3 and the cover resin layer 4 at the time of thermal curing may be suppressed.

As mentioned above, in one embodiment of the present invention, a filling factor of the filler particles 4*a* in the cover resin layer 4 may be set to not less than 80 vol %. By setting a filling factor of the filler particles 4*a* in the cover resin layer 4 to not less than 80%, thermal shrinkage of the cover resin layer 4 at the time of thermal curing can be sufficiently suppressed.

In order to confirm that thermal shrinkage of the cover resin layer 4 is suppressed by setting a filling factor of the filler particles 4*a* in the cover resin layer 4 to not less than 80 vol %, the following procedure was taken. First, by following the above-mentioned manufacturing method, on a working substrate, the magnetic substrate 2, the insulation resin layer 3, and the cover resin layer 4 were stacked in this order, and thus each sample of a laminate was formed. There were formed seven types of samples varying in filling factor of the filler particles 4*a* in the cover resin layer 4. Specifically, these seven types of samples were set to have a filling factor of the filler particles 4*a* in the cover resin layer 4 of 50 vol %, 60 vol %, 70 vol %, 75 vol %, 80 vol %, 85 vol %, and 90 vol %, respectively. Polyimide was used as a resin material of the insulation resin layer 3, and particles of SiO2 were used as the filler particles 3*a*. Furthermore, polyimide was used as a resin material of the cover resin layer 4, and Fe—Si—Cr-based metal magnetic particles were used as the filler particles 4*a*. The insulation resin layer 3 and the cover resin layer 4 were heated at 200° C. for 40 minutes so that the resins included in these layers were thermally cured.

With respect to each of these samples, after the cover resin layer 4 was thermally cured, it was visually confirmed whether or not any of the samples (laminates) had been peeled off from the working substrate. Specifically, with respect to each of these types of samples, ten laminates were formed, and the number of the laminates peeled off from the working substrate was counted Results thereof are shown in Table 1 below.

TABLE 1

| | Sample 1 | Sample 2 | Sample 3 | Sample 4 | Sample 5 | Sample 6 | Sample 7 |
|---|---|---|---|---|---|---|---|
| Filling Factor | 50% | 60% | 70% | 75% | 80% | 85% | 90% |
| No. of Peeled-off Laminates | 6/10 | 4/10 | 3/10 | 1/10 | 0/10 | 0/10 | 0/10 |
| Determination | Defective | Defective | Defective | Defective | Satisfactory | Satisfactory | Satisfactory |

Based on the results shown in Table 1, those of the samples whose filling factor of the filler particles 4*a* in the cover resin layer 4 was not more than 75 vol % (Sample 1 to Sample 4) had one or more laminates peeled off from the working substrate and thus were judged to be defective. On the other hand, those of the samples whose filling factor of the filler particles 4*a* in the cover resin layer 4 was not less than 80 vol % (Sample 5 to Sample 7) had no laminates peeled off from the working substrate and thus were judged to be satisfactory. As described above, it could be confirmed that thermal shrinkage of the cover resin layer 4 is suppressed by setting a filling factor of the filler particles 4*a* in the cover resin layer 4 to not less than 80 vol %.

The dimensions, materials, and arrangement of the various constituent components described in this specification are not limited to those explicitly described in the embodiments, and the various constituent components can be modified to have arbitrary dimensions, materials, and arrangement within the scope of the present invention. Furthermore, constituent components not explicitly described in this specification can also be added to the embodiments described, and some of the constituent components described in the embodiments can also be omitted.

What is claimed is:

1. A laminated coil, comprising:

a magnetic substrate formed of a sintered magnetic material;

an insulation resin layer formed on the magnetic substrate and including a first resin and first filler particles;

a cover resin layer formed on the insulation resin layer and including a second resin and second filler particles; and an external electrode provided at least on an outer surface of the insulation resin layer and the cover resin layer;

wherein the insulation resin layer comprises a plurality of insulation layers and conductor layers including a coil conductor, each of the conductor layers being formed on one of the plurality of insulation layers such that an upper surface of one of the conductor layers is in direct contact with a lower surface of the cover resin layer, wherein a filling factor of the second filler particles in the cover resin layer is higher than a filling factor of the first filler particles in the insulation resin layer.

2. The laminated coil according to claim 1, wherein the second filler particles in the cover resin layer are a magnetic material, and a filling factor of the second filler particles in the cover resin layer is not less than 70 vol %.

3. The laminated coil according to claim 1, wherein the first filler particles have spherical shape.

4. The laminated coil according to claim 1, in the first filler particles are formed in a flattened shape.

5. The laminated coil according to claim 1, wherein the second filler particles have a spherical shape.

6. The laminated coil according to claim 1, wherein the second filler particles are formed in a flattened shape.

7. The laminated coil according to claim 1, wherein the second filler particles are metal magnetic particles.

8. A laminated coil, comprising:

a magnetic substrate formed of a sintered magnetic material;

an insulation resin layer formed on the magnetic substrate and including a first resin;

a cover resin layer formed on the insulation resin layer and including a second resin and filler particles; and an external electrode provided at least on an outer surface of the insulation resin layer and the cover resin layer;

wherein the insulation resin layer comprises a plurality of insulation layers and conductor layers including a coil conductor, each of the conductor layers being formed on one of the plurality of insulation layers such that an upper surface of one of the conductor layers is in direct contact with a lower surface of the cover resin layer, wherein the insulation resin layer includes no filler particles across an entire area thereof, and the filler particles included in the cover resin layer are metal magnetic particles, and wherein a filling factor of the filler particles in the cover resin layer is not less than 80 vol %.

9. The laminated coil according to claim 8, wherein the filler particles have a spherical shape.

10. The laminated coil according to claim 8, wherein the filler particles are formed in a flattened shape.

11. The laminated coil according to claim 1, further comprising:

an extraction conductor configured to connect the external electrode to the coil conductor.

12. The laminated coil according to claim 1, wherein the laminated coil is formed as a common mode coil.

13. The laminated coil according to claim 1, wherein the filling factor of the second filler particles is 10% or more higher than the filling factor of the first filler particles.

14. The laminated coil according to claim 13, wherein the filling factor of the second filler particles is 20% or more higher than the filling factor of the first filler particles.

15. The laminated coil according to claim 1, wherein a coil axis extends orthogonal or substantially orthogonal to the insulation resin layer, and wherein a longest axis direction of at least a part of the first filler particles in the insulation resin layer is oriented to a direction parallel to the coil axis.

16. The laminated coil according to claim 1, wherein a coil axis extends orthogonal or substantially orthogonal to the insulation resin layer, and wherein a longest axis direction of at least a part of the second filler particles in the cover resin layer is oriented to the direction perpendicular to the coil axis.

* * * * *